US007648080B2

(12) United States Patent
Höhne et al.

(10) Patent No.: US 7,648,080 B2
(45) Date of Patent: Jan. 19, 2010

(54) RAIL FIXING DEVICE

(75) Inventors: Hubertus Höhne, Butzbach (DE); Hans-Ulrich Dietze, Wusterwitz (DE); Heinz Ossberger, Grosslobming (AT); Josef Leitner, Weisskirchen (AT); John Porrill, Godalming (GB); David R. Seeley, Bengeo (GB)

(73) Assignees: BWG GmbH & Co. KG, Butzbach (DE); VAE GmbH, Vienna (AT); Pandrol Limited, Addlestone Surrey (GB); VAE Eisenbahnsysteme GmbH, Zeltweg (AT)

( * ) Notice: Subject to any disclaimer, the term of this patent is extended or adjusted under 35 U.S.C. 154(b) by 504 days.

(21) Appl. No.: 11/629,483

(22) PCT Filed: Jun. 17, 2005

(86) PCT No.: PCT/EP2005/006578

§ 371 (c)(1),
(2), (4) Date: Jan. 4, 2007

(87) PCT Pub. No.: WO2005/124025

PCT Pub. Date: Dec. 29, 2005

(65) Prior Publication Data

US 2008/0093472 A1 Apr. 24, 2008

(30) Foreign Application Priority Data

Jun. 21, 2004 (DE) ..... 10 2004 029 730
Jun. 30, 2004 (DE) ..... 10 2004 031 632

(51) Int. Cl.
*E01B 9/00* (2006.01)

(52) U.S. Cl. ..... 238/351; 238/310; 238/338; 238/343

(58) Field of Classification Search ..... 238/264, 238/283, 297, 310, 338, 343, 349, 351, 354, 238/382
See application file for complete search history.

(56) References Cited

U.S. PATENT DOCUMENTS

| | | | | | |
|---|---|---|---|---|---|
| 4,325,510 | A * | 4/1982 | Sherrick | 238/341 |
| 4,349,150 | A * | 9/1982 | Lubbers | 238/265 |
| 4,756,477 | A * | 7/1988 | Schumaker | 238/315 |
| 4,844,338 | A * | 7/1989 | Bucksbee | 238/283 |
| 4,967,954 | A * | 11/1990 | von Lange | 238/310 |
| 5,221,044 | A * | 6/1993 | Guins | 238/349 |
| 5,361,986 | A * | 11/1994 | Meier et al. | 238/283 |
| 5,692,677 | A * | 12/1997 | Duconseil | 238/283 |
| 6,079,631 | A * | 6/2000 | Ortwein et al. | 238/283 |
| 6,499,667 | B1 * | 12/2002 | Rhodes et al. | 238/264 |
| 6,619,558 | B1 * | 9/2003 | Jang | 238/283 |
| 6,651,897 | B1 * | 11/2003 | Porrill et al. | 238/310 |

(Continued)

FOREIGN PATENT DOCUMENTS

| | | |
|---|---|---|
| DE | 9320372 | 6/1994 |

(Continued)

*Primary Examiner*—S. Joseph Morano
*Assistant Examiner*—Jason C Smith
(74) *Attorney, Agent, or Firm*—Dennison, Schultz & MacDonald

(57) ABSTRACT

A rail fixing device including a tensioning clamp extending from a holding element and removably arranged on a ribbed plate on which the rail base is mounted. The ribbed plate is placed on an elastic intermediate layer which is maintained in a required prestressed state by the holding element.

25 Claims, 15 Drawing Sheets

U.S. PATENT DOCUMENTS

| | | | | |
|---|---|---|---|---|
| 6,761,322 | B1 * | 7/2004 | Porrill et al. | 238/264 |
| 6,880,764 | B2 * | 4/2005 | Schwarzbich | 238/287 |
| 7,261,244 | B2 * | 8/2007 | Urmson et al. | 238/287 |
| 7,374,109 | B2 * | 5/2008 | Ellerhorst | 238/283 |
| 7,533,829 | B2 * | 5/2009 | Osler et al. | 238/264 |
| 2004/0084548 | A1 * | 5/2004 | Schwarzbich | 238/310 |
| 2007/0235551 | A1 * | 10/2007 | Ellerhorst | 238/283 |
| 2008/0093472 | A1 * | 4/2008 | Hohne et al. | 238/351 |

FOREIGN PATENT DOCUMENTS

| | | |
|---|---|---|
| GB | 2370062 | 6/2002 |

* cited by examiner

RAIL FIXING DEVICE

This application is a filing under 35 USC 371 of PCT/EP2005/006578, filed Jun. 17, 2005.

The invention relates to an arrangement for mounting a rail having a rail foot on a support, such as a concrete tie using a load-distributing plate, such as a ribbed plate, arranged between the rail foot and the support, a resilient first intermediate layer supporting the plate relative to the support, and, if required, a second intermediate layer, extending between the first intermediate layer and the support, of essentially inflexible material such as hard plastic, a holding element being connected to the support, from which holding element extends at least one resilient clip which comprises several legs, and which supports itself directly or indirectly on the rail foot.

A corresponding arrangement is found in EP-B-0 619 852. Here, the clip exhibits approximately an M-shape in plan view and comprises two outer legs and two inner legs, which are connected to each other by arch sections. The outer legs are fixed in receptacles of a holding element, whereas the inner legs, or rather the arch connecting them, rest on a rail foot. The holding element comprises two spaced-apart shoulders with U-shaped channel-like openings that serve as receptacles, into which the ends of the outer legs can be driven, so that the inner legs hold down, with the necessary prestress, the rail which is to be secured. The holding element can either be embedded in a concrete tie through a stud or can be joined, e.g. by welding, to a ribbed plate.

A clip, which in plan view exhibits an E-shape, for fastening a rail is known from AT-C-350 608. For the purpose of fixing the clip, a leg is driven into a channel of an anchor element, which in turn is cast into a concrete tie.

A clip with W-shaped geometry is described in DE-C-30 18 091. Sections of the clip are fixed in a channel-like depression of an angular-guide plate. Opposing sections of the clip rest on a rail foot. The clip itself is connected to a concrete tie through a through-bolt.

Rail fastening systems with clips known in the art have the disadvantage that not enough space is available, in particular in the area of rail switches and rail intersections where the rails are positioned in close proximity to each other, for positioning and securing the clips. For this reason, these areas in principle require customized designs for fastening the rails.

The problem to be solved by the present invention is to further develop a rail fastening arrangement of the above-mentioned type in such a way that uncomplicated construction measures can be used to secure the rail or rails in the region of a switch, in particular, whereby an resilient bearing of the rail should be possible to a degree as is known according to the state of technology and is required in the area of switches. In particular, the goal is to provide the capability of carrying a rail with simple design measures in such a way that the spring system, formed by the resilient clip and the resilient first intermediate layer, exhibits a characteristic curve with a bend, so that good damping is provided when passing, but that otherwise a quasi rigid unit results. Independently of this, it should be ensured that the stresses on the clips do not lead to a loss in fatigue strength.

According to the invention, this problem is solved mainly by the fact that the holding element is formed as a first insert that is removably insertable into the load-distributing plate and/or forms a unit with the plate, and that the load-distributing plate can be directly or indirectly preloaded relative to the support through the holding element.

Direct preloading through the holding element means that the holding element establishes the prestressing of the load-distributing plate, i.e. the degree to which the resilient first intermediate layer is compressed in the absence of an additional load on the rail. The load-distributing plate is then adjustable relative to the holding element in the direction of the support, so that the required prestressing of the clip can be effected. A construction of this type is intended in particular for firm rail bearings.

In contrast, indirect preloading means that the load-distributing plate and the holding element form a unit—be that by means of a positive connection, or by an integral formation—and that the preloading is established by a spacer element, which preferably is insertable as a removable insert into the holding element, which consequently is adjustable relative to the insert.

By employing measures of this type, the bearing of the rail on the support point can be developed as firm or soft as is required, whereby a high resilience can be achieved through an indirect preloading of the load-distributing plate through the holding element, since a relative movement between the load-distributing plate and the holding element will not take place and as a result the clip itself does not have to follow large excursions of the spring system. This ensures the required fatigue strength.

As a further development of the invention it is provided that the holding element has a base section with a shaped projection extending along the bottom, and that from the area of the base section facing away from the shaped projection, i.e. its upper side, extends at least one receptacle, such as a shoulder or channel, in which extends one leg of the clip or a section of a leg.

In a sectional view, the shaped projection preferably exhibits a circular or oval geometry of its circumference, whereby the planar extent preferably is smaller than the planar extent of the base section. In a structure of this type, the holding element is inserted into the load-distributing plate from the side further from the support. If the planar extent of the base section is smaller than that of the shaped projection, the holding element will have to be inserted from the bottom of the load-distributing plate.

Differing from sleeper mountings known in the art, the invention proposes a holding element with a clip, in which the holding element is removably insertable into a load-distributing plate, which in turn can be formed as a ribbed plate or as an elevated region in the vicinity of a heel of a switch tongue. The holding element is then secured by a screw element passing through it, such as a through-bolt, the load-distributing plate being, at the same time, fixed by the holding element.

In particular, it is foreseen that the shaped projection of the holding element not only engages by a positive connection into the load-distributing plate, but rather also has a shape- and friction-locked connection with the latter, if prestressing of the load-distributing plate is to be achieved directly through the holding element.

When securing the holding element and with it the load-distributing plate, a first support surface of the holding element rests on a section of the load-distributing plate forming a second support surface. In addition, the holding element should have an axial opening, in which is located a second insert, which is movable relative to the holding element and through which passes the screw element, e.g. a through-bolt, which connects the holding element to the support and which can be screwed directly or indirectly into the support. If the holding element is then fixed and therefore the load-distributing plate is fixed as well, the screw element, or a disk-shaped element that the screw element passes through, rests with a frictional connection either on a third support surface of the holding element, at the side facing away from the support, or on the second insert, depending on whether the load-bearing plate is to be prestressed directly or indirectly through the holding element.

For prestressing to be applied indirectly through the holding element, i.e. when the second insert is tightened positively between the screw element and the support, or an essentially rigid plate arranged thereon, a special embodiment of the invention provides that at least two projections protrude peripherally from the shaped projection, with the respective clearances of the projections to the support surface extending from the holding element being equal to or slightly greater than the clearance between the second support surface, extending from the load-distributing plate and the bottom surface of the load-dissipating plate, along which extends or from which extends the resilient first intermediate layer. Thus, the peripherally protruding projections can embrace the load-distributing plate, making it possible to achieve the desired positive connection.

To achieve this technically, an independently inventive proposal provides that the holding element be connected to the load-distributing plate in a bayonet-joint-like manner. For this purpose, the through-opening which accepts the insert, of the load distributing-plate has a geometry that is matched to the outer geometry of the shaped projection. However, the cut-outs associated with the projections extend in such a manner that the holding element must be inserted into the load-distributing plate in a position that is offset relative to the position that is oriented towards the rail foot, so that it can subsequently be rotated and be oriented towards the rail to be secured.

If, as mentioned, the holding element is preferably removably connected to the load-distributing plate, then it is of course also possible that the two are formed as an integral unit. For example, the load-distributing plate and the holding element can be formed as one piece, for example by casting.

To achieve the desired prestressing, the following constructional options, in particular, are available. If the load-distributing plate is prestressed directly through the holding element, then, with the screw element or the disk-shaped element through which it passes supported by fictional engagement, the holding element rests through a fourth support surface on the support, such as the concrete tie or the second intermediate plate, which is made substantially inflexible and for example consists of hard plastic. A clearance then exists, between the first and the fourth support surfaces of the holding element, which is smaller than the thickness of the resilient first intermediate layer, when the screw element is loosened, and the clearance between the second support surface and the undersurface of the load-distributing plate. Consequently, when the screw element is tightened, and thus the holding element and therefore the load-distributing plate are secured, the resilient first intermediate layer is compressed to the required degree and the desired prestressing is achieved.

For indirect prestressing, i.e. the screw element or the disk-shaped rests in a frictionally engaged manner upon the second insert, the second insert has an axial extent which, upon tightening of the screw element, results in a displacement of the holding element with the load-distributing plate in the direction of the support and consequently a compression of the resilient first intermediate layer. The screw element, i.e. its head or the disc-shaped element, then obviously rests upon a region of the holding element. Since in this case the holding element and the load-distributing plate form a unit, the clip only has to compensate for tilting forces introduced by the rail, so that no loss of fatigue strength occurs.

A further proposal of the invention provides that two shoulders, each of which accommodates one leg section of the clip, extend from the base section of the holding element, the screw element, such as a through-bolt, extending between the shoulders. Also extending between the shoulders is the leg or legs of the clip, which rests or rest upon the rail foot or upon an element, and by which rails running next to each other can be secured An independently inventive proposal of the invention, it is provided that the base section of the holding element is arranged between two rail feet, that two pairs of shoulders extend from the base section, that one clip extends from each pair of shoulders, and that between two pairs of shoulders there extends a plate element which is adjustable relative to the base element and which rests upon the rail feet, and upon which rests at least one leg of each clip. Instead of two pairs of shoulders, two spaced-apart channel-like receptacles can extend from the base section in order to be able to accept a leg of a clip exhibiting an E-shape in plan view, as described in AT-C-350 608.

By the construction of the clips which are supported on a plate element mounted on the rail feet, reliable holding down of rails that run immediately next to each other, as is the case in the region of rail switches and rail intersections, is possible in a simple manner.

The base section, which comprises the two pairs of shoulders or the two channels, preferably exhibits a quadratic geometry, whereby from the base section projects a quadratically shaped protrusion, having a cross-section of rectangular geometry with rounded corners and engaging the load-dissipating plate and having a positive connection with the latter.

The intermediate plate, or its support surfaces for the clips, should then have a slope that corresponds to the slope of the rail foot that is usually to be secured.

The holding element or the first insert comprises metal, whereas the second insert comprises plastic, in particular polyamide with a fibre glass content between 50% and 70%, preferably approximately 60%.

Further details, advantages, and characteristics of the invention can be found not only in the claims and the features described therein, independently and/or in combination, but also in the following description of preferred embodiments shown in the drawings, in which:

Figure 1:
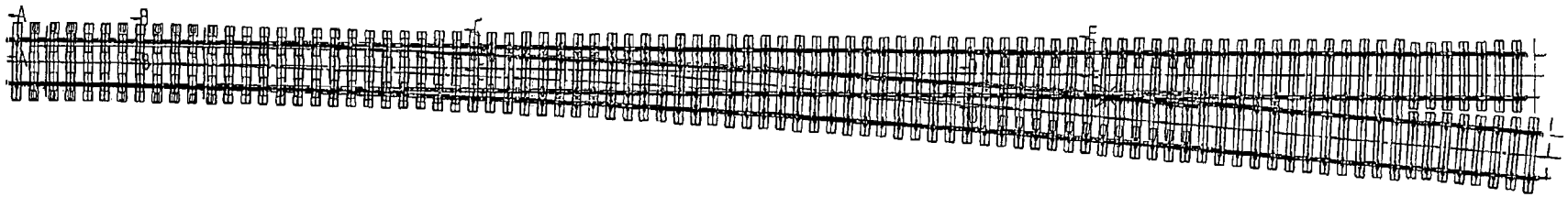
FIG. 1 shows the layout of a rail switch.
Figure 2:
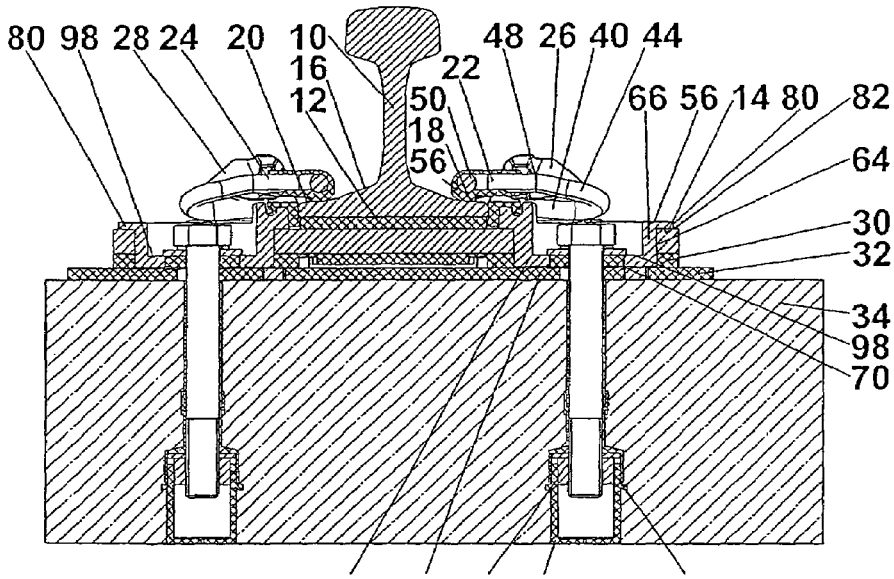
FIG. 2 shows a sectional view along the line A-A of FIG. 1.
Figure 3:
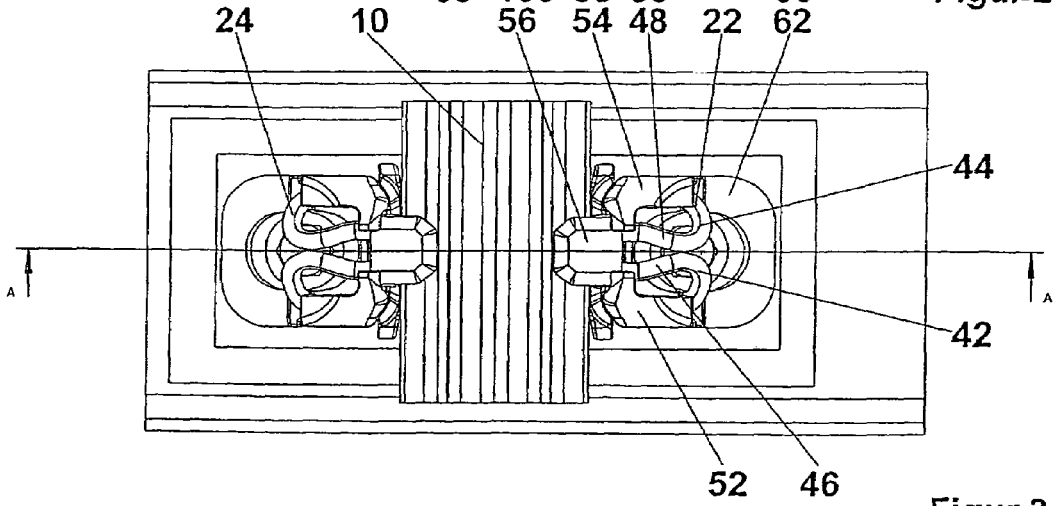
Figure 4:
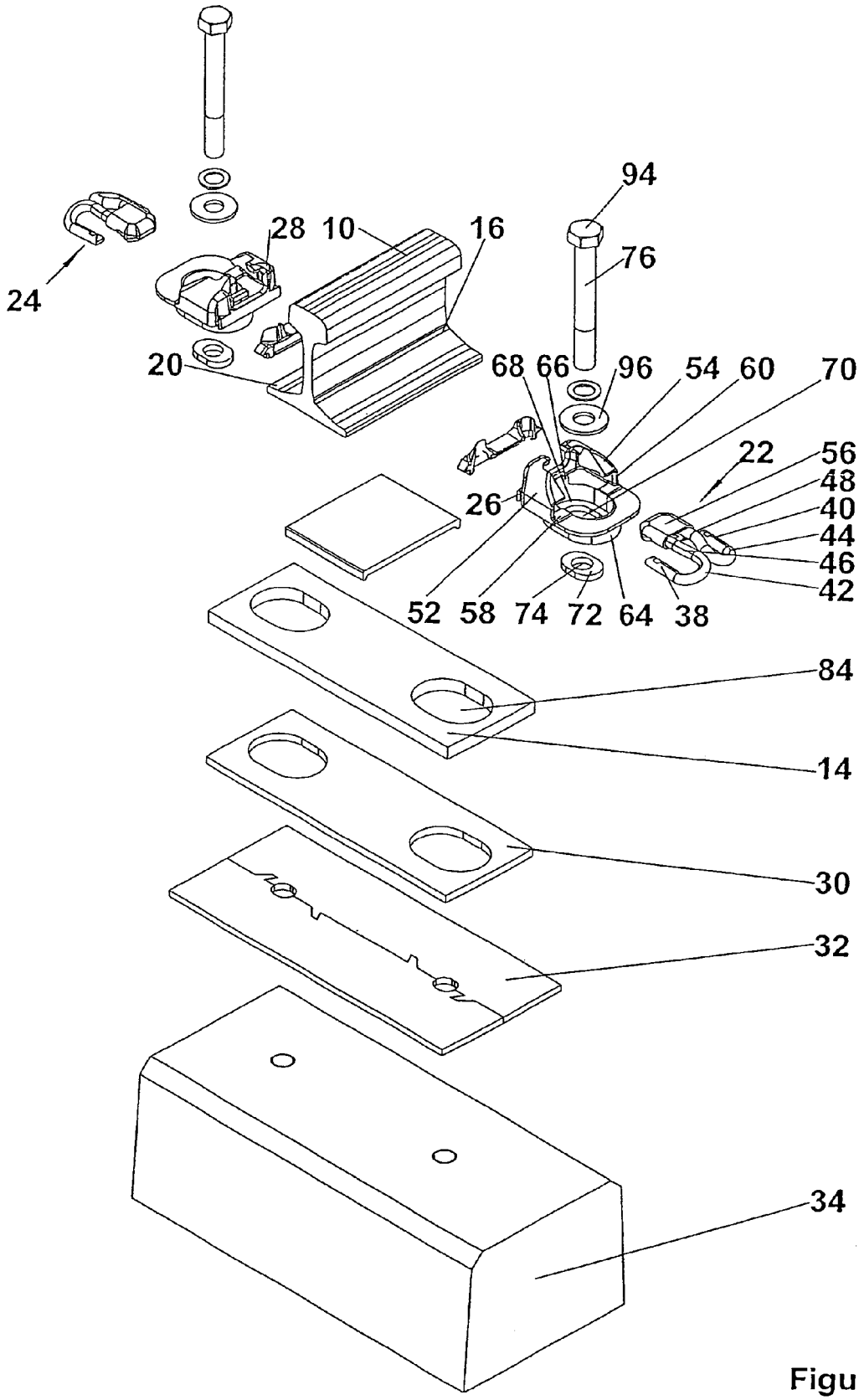
Figure 5:
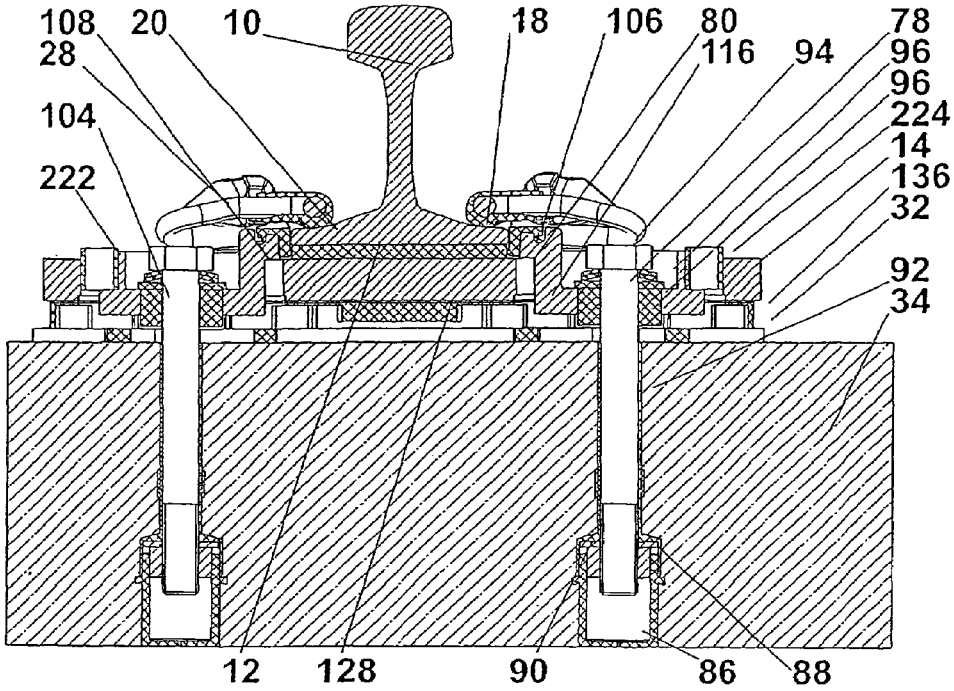
Figure 6:
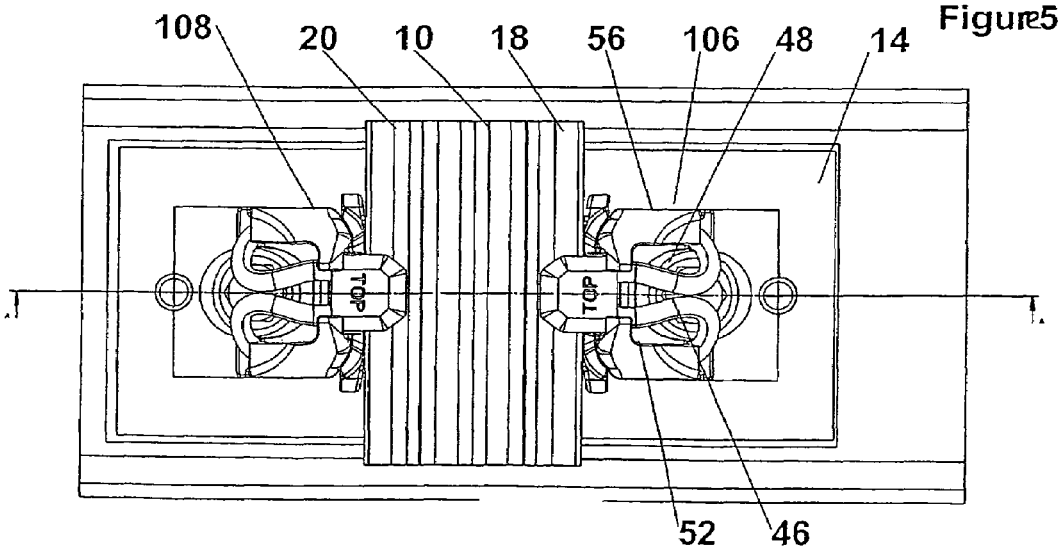
Figure 7:
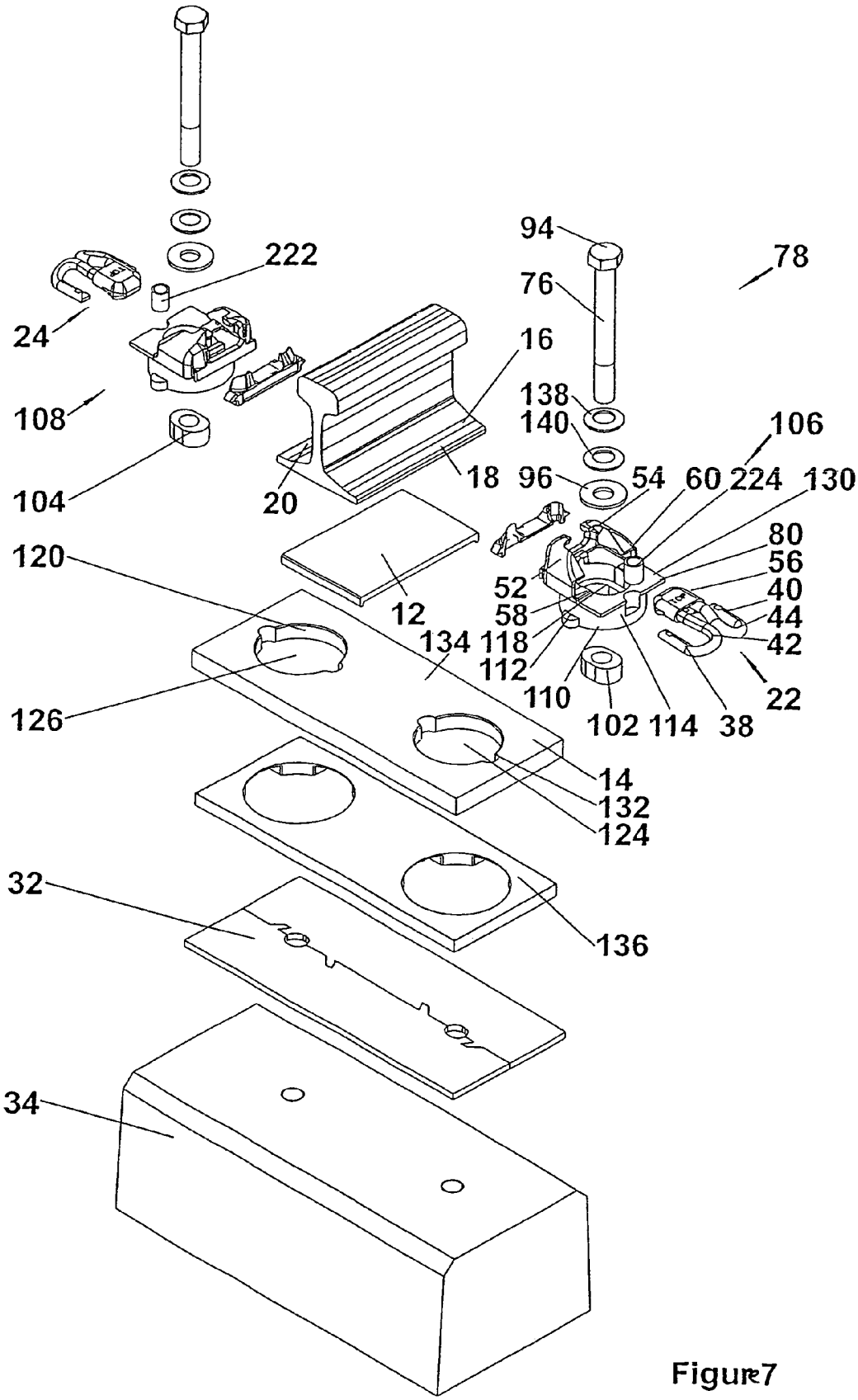
Figure 8:
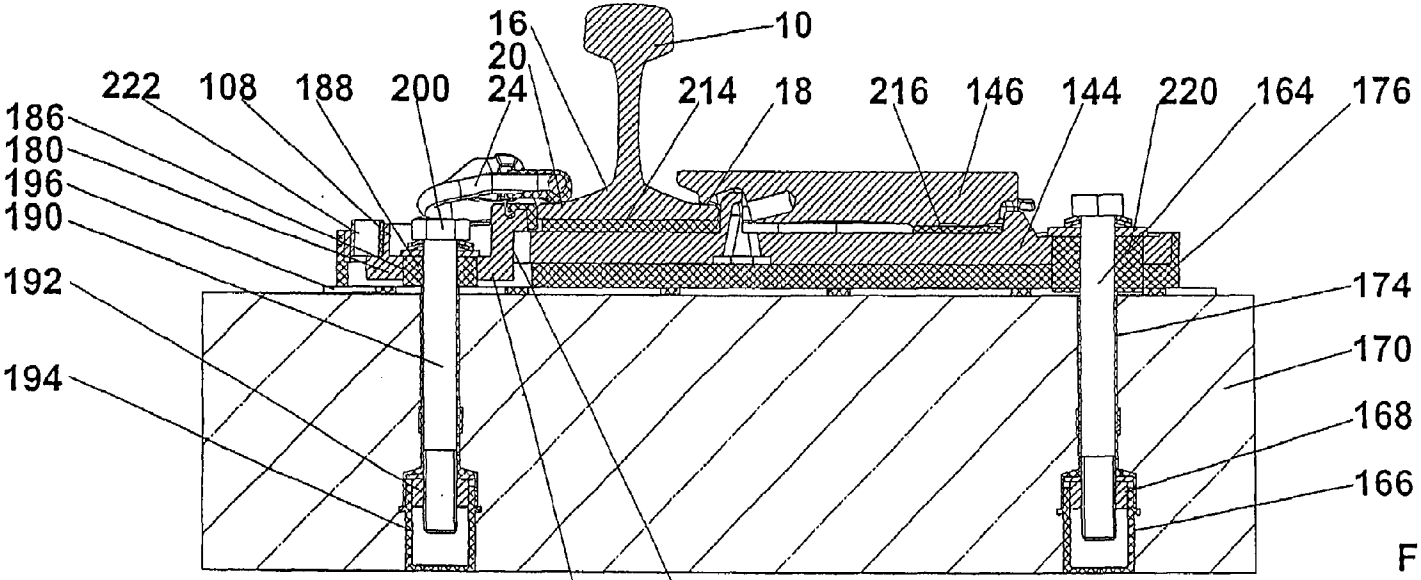
Figure 9:
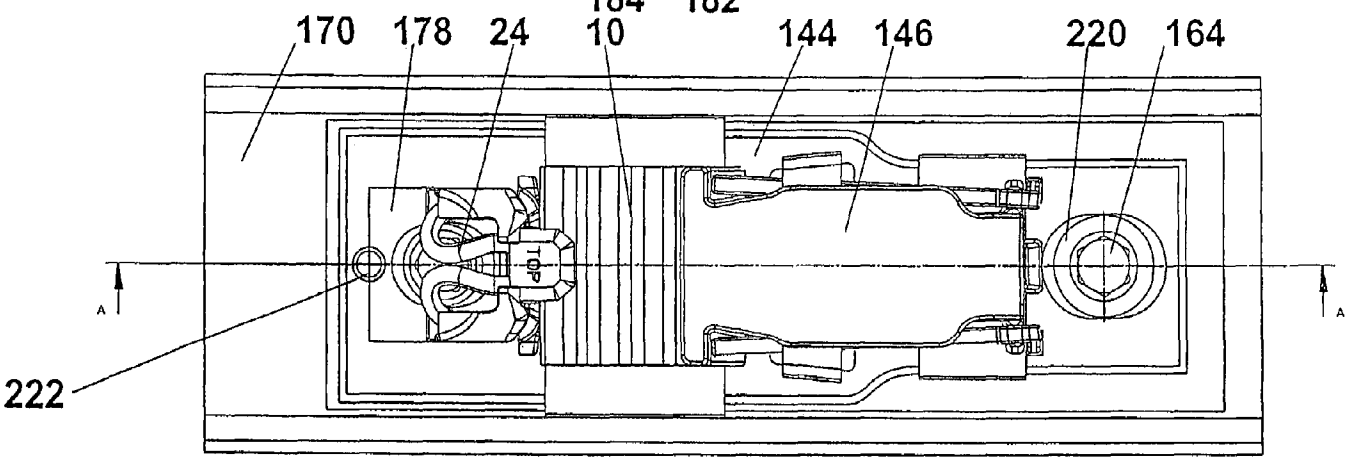
Figure 10:
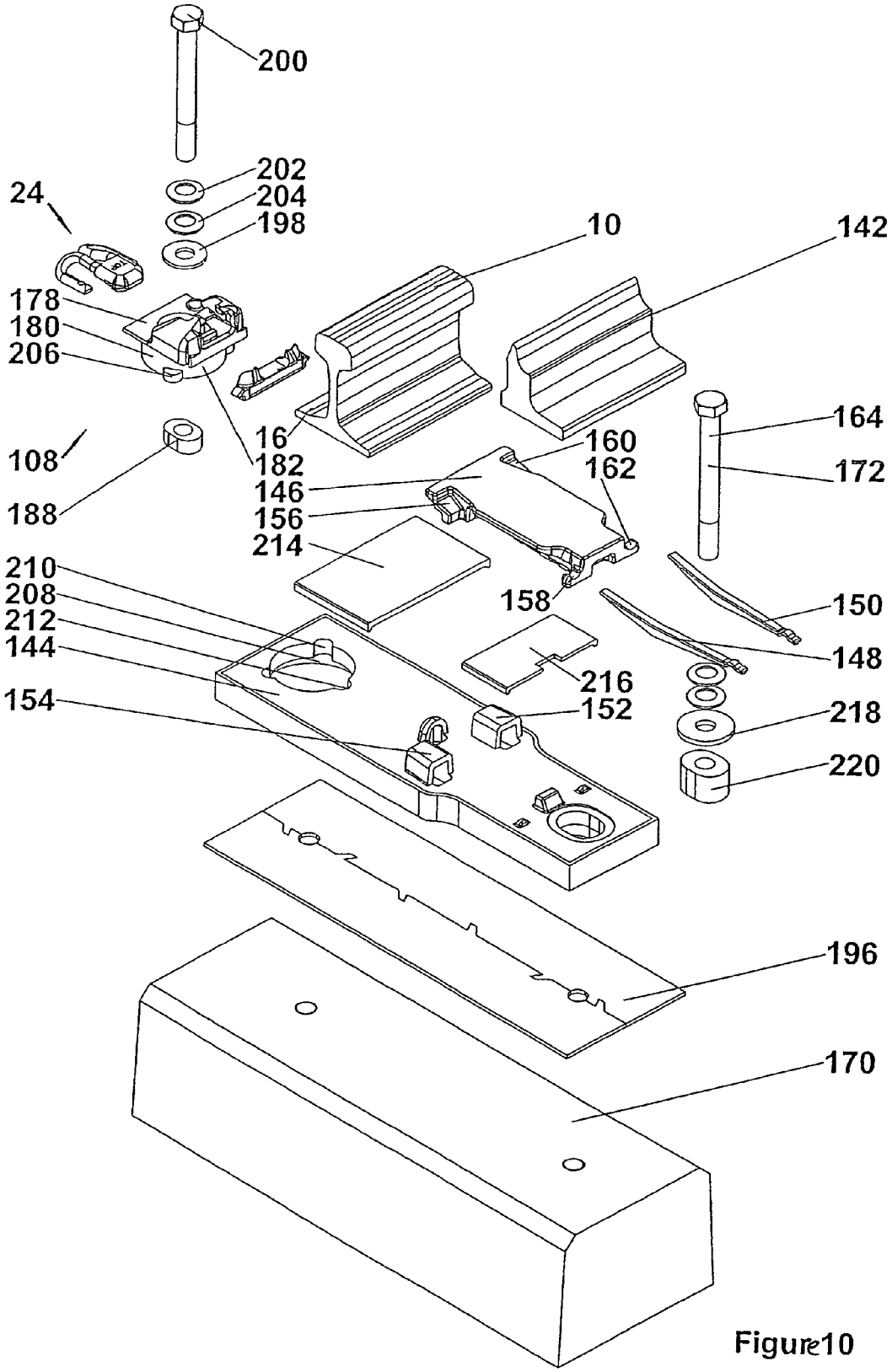
Figure 11:
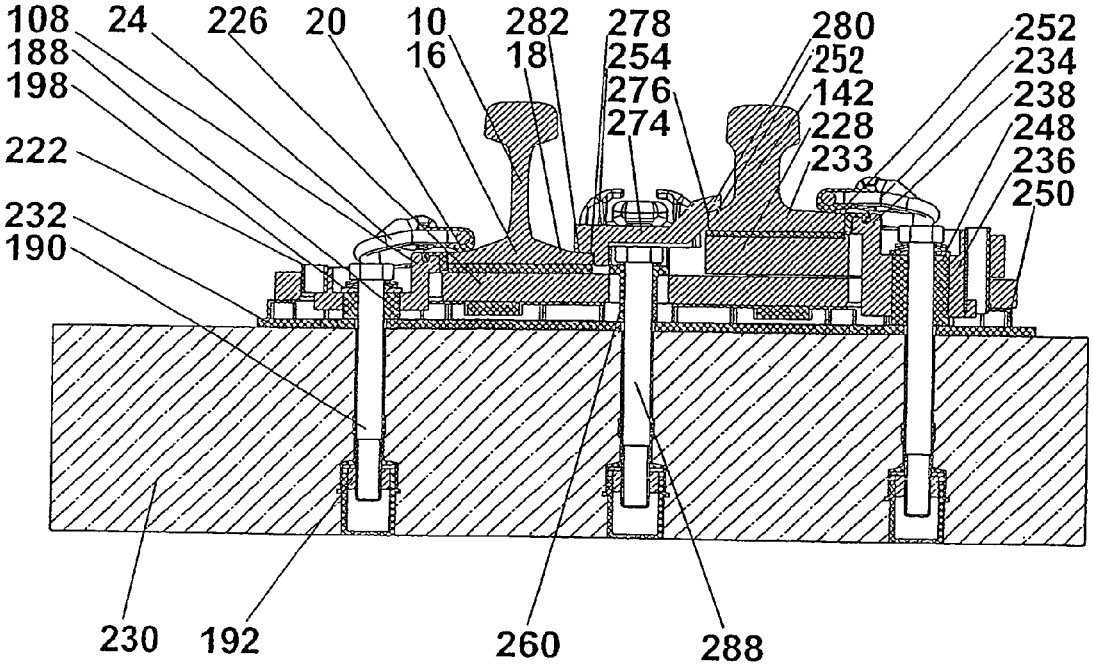
Figure 12:
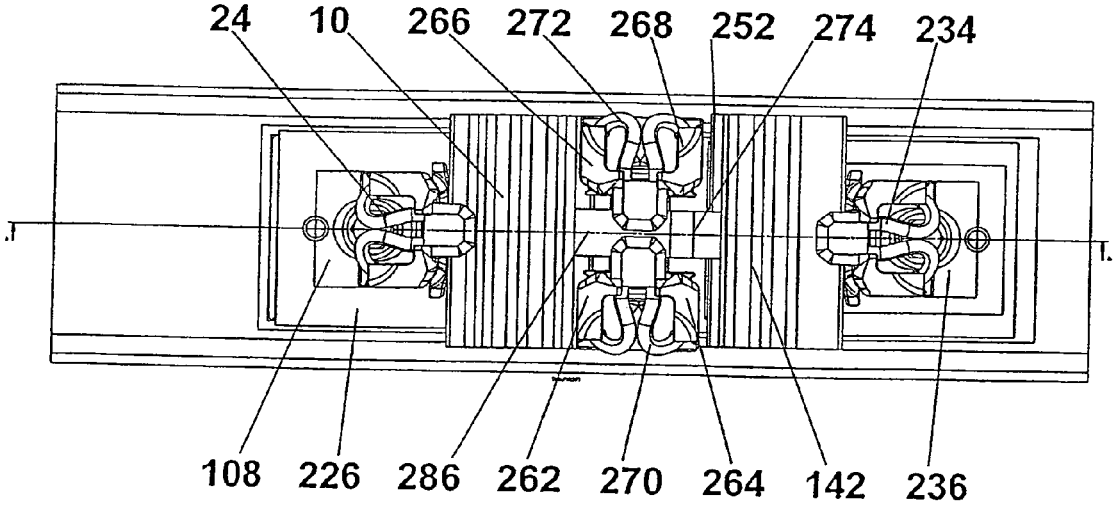
Figure 13:
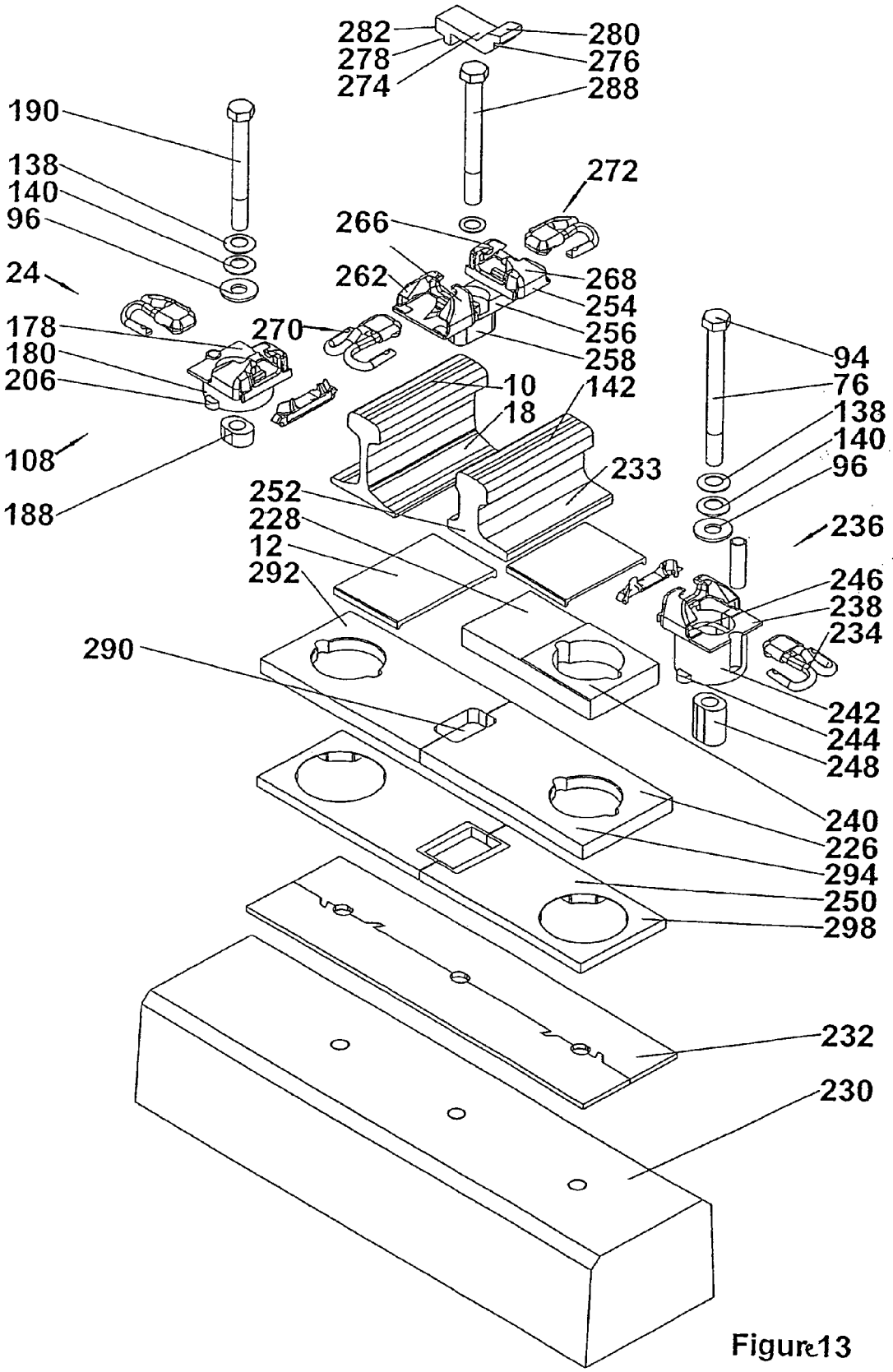
Figure 14:
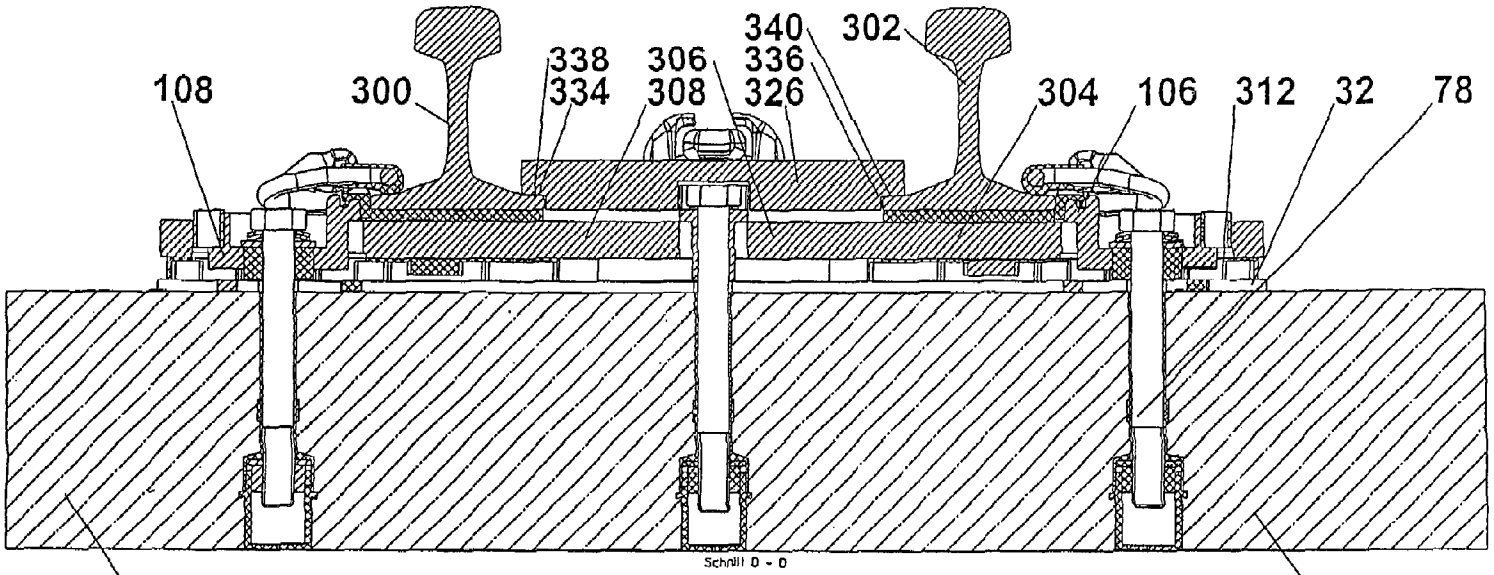

FIG. 3 shows a top view onto a part of a concrete tie in the region of the section A-A of FIG. 2, FIG. 4 shows an exploded view of the elements illustrated in FIGS. 2 and 3, FIG. 5 shows an alternative embodiment to the one illustrated in FIG. 2, FIG. 6 shows a plan view onto the region illustrated in FIG. 5, FIG. 7 is an exploded illustration of the elements of the region of FIGS. 5 and 6, FIG. 8 shows a sectional view along the line B-B of FIG. 1, FIG. 9 shows a plan view onto the illustrated section of FIG. 8, FIG. 10 shows an exploded view of the elements of FIGS. 8 and 9, FIG. 11 shows a sectional view along the line C-C of FIG. 1, FIG. 12 shows a plan view in the region of the section C-C of FIG. 11, FIG. 13 shows an exploded view of the elements of FIGS. 11 and 12, FIG. 14 shows a sectional view along the line D-D of FIG. 1,9

Figure 15:
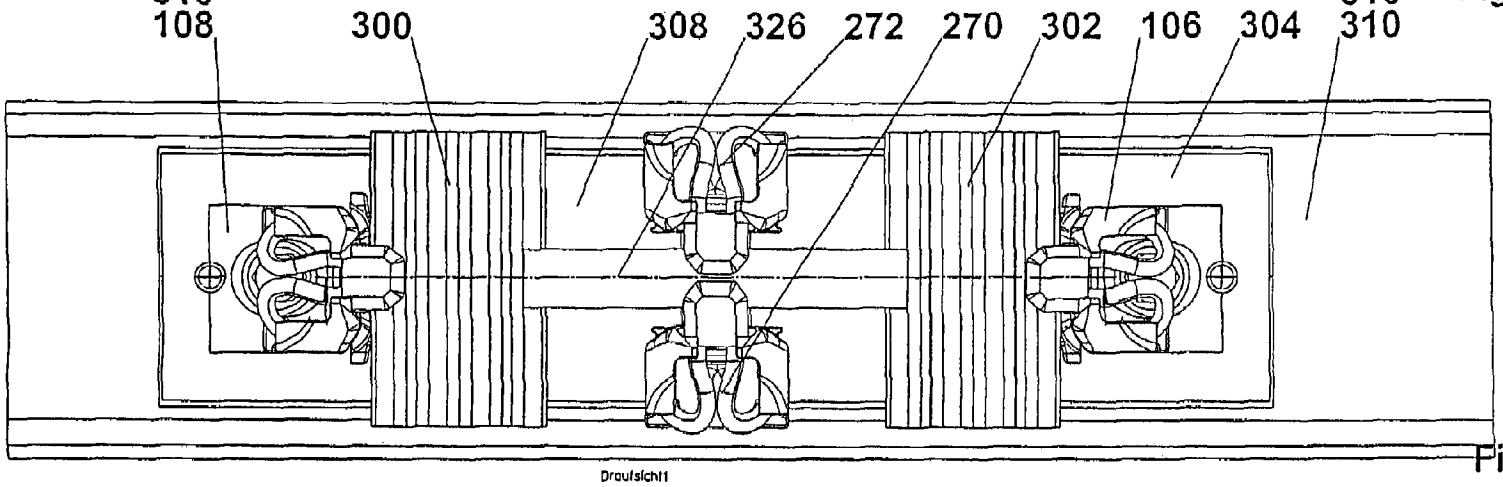

FIG. 15 shows a plan view of the section of FIG. 14

Figure 16:
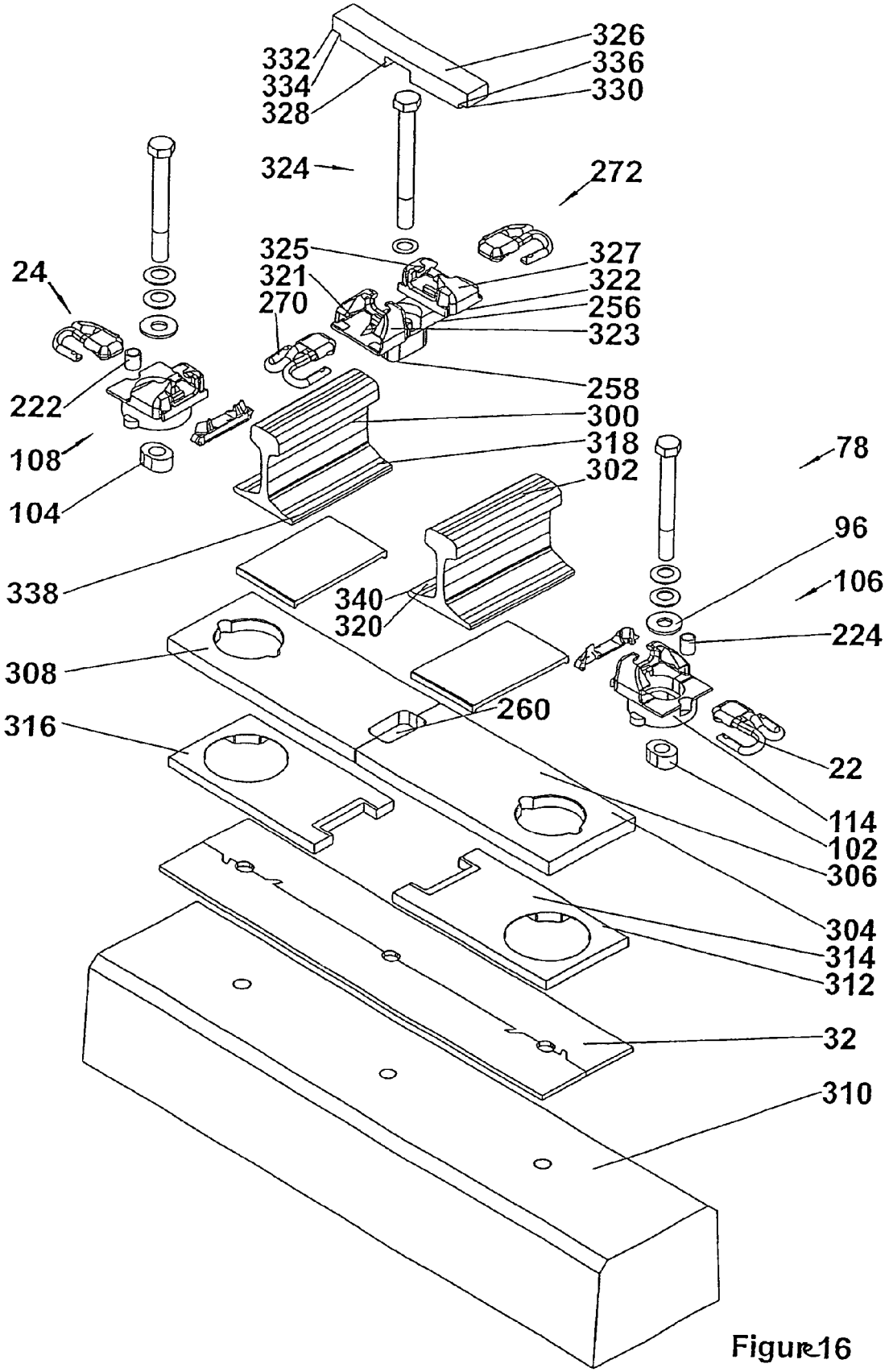
Figure 17:
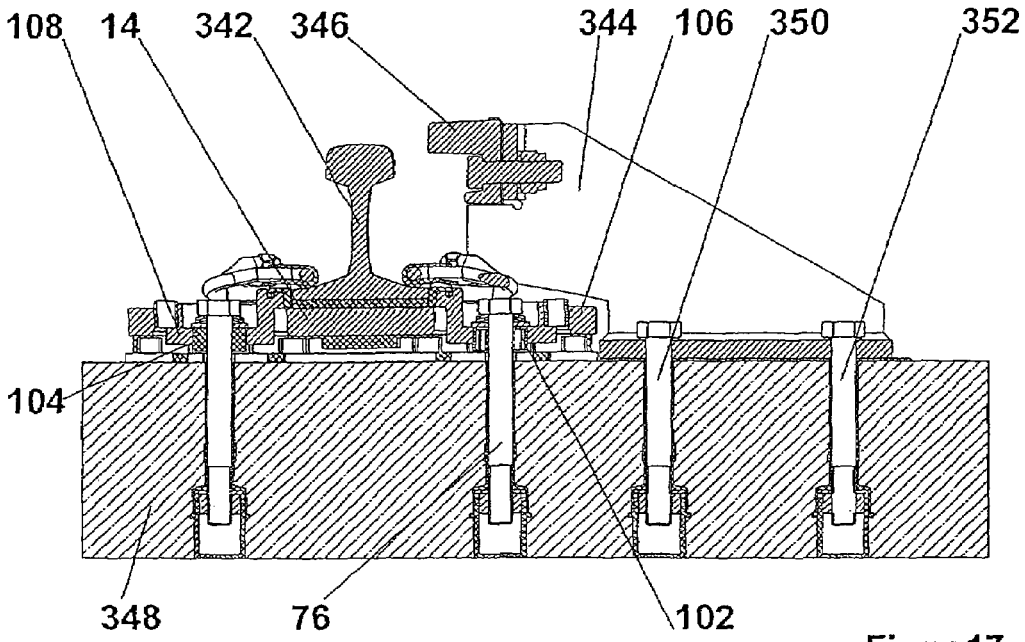
Figure 18:
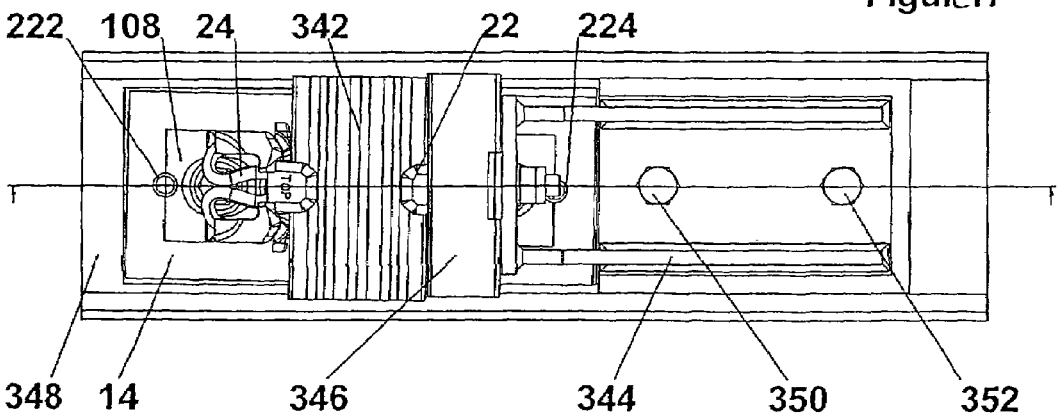
Figure 19:
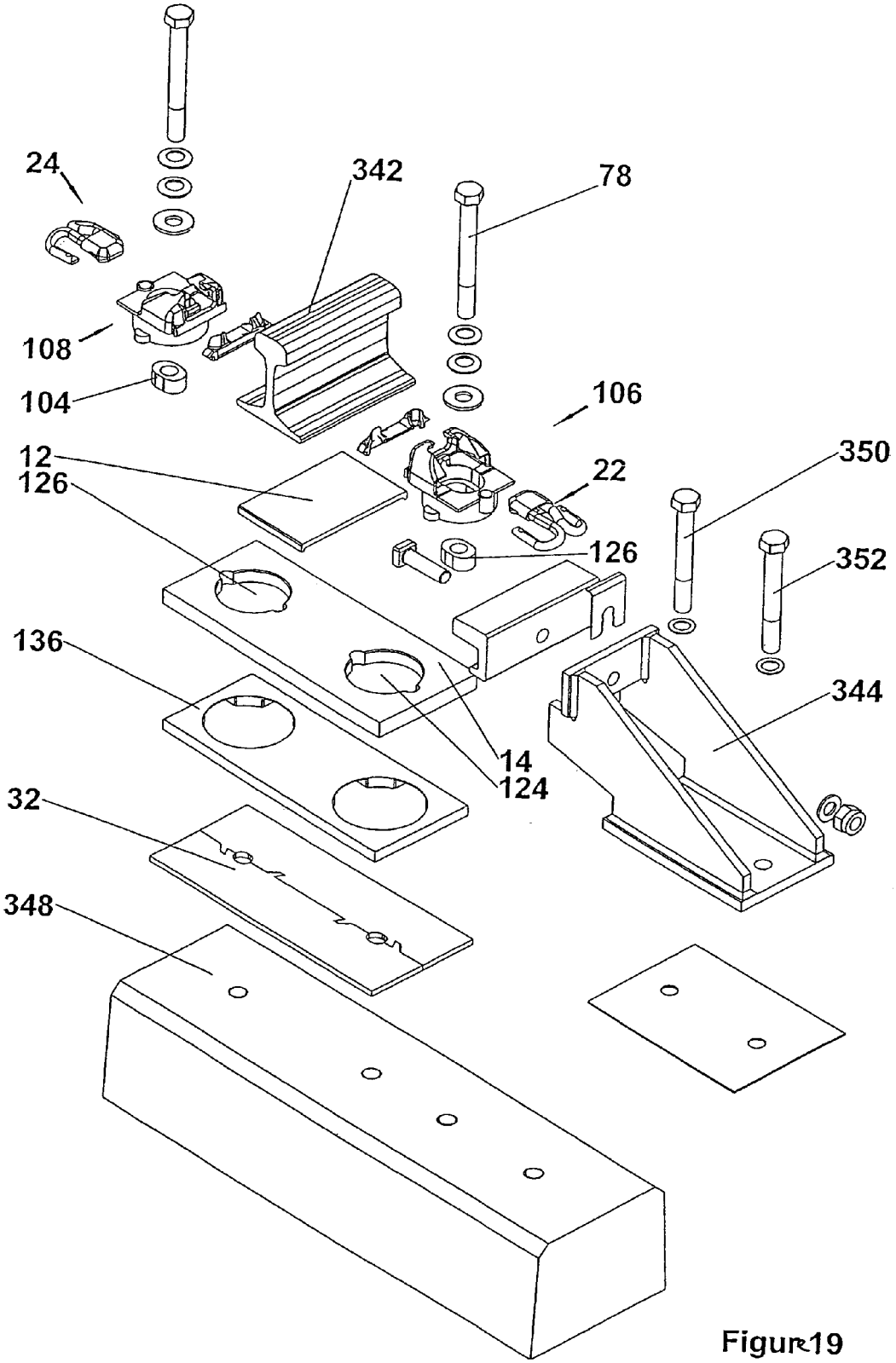
Figure 20:
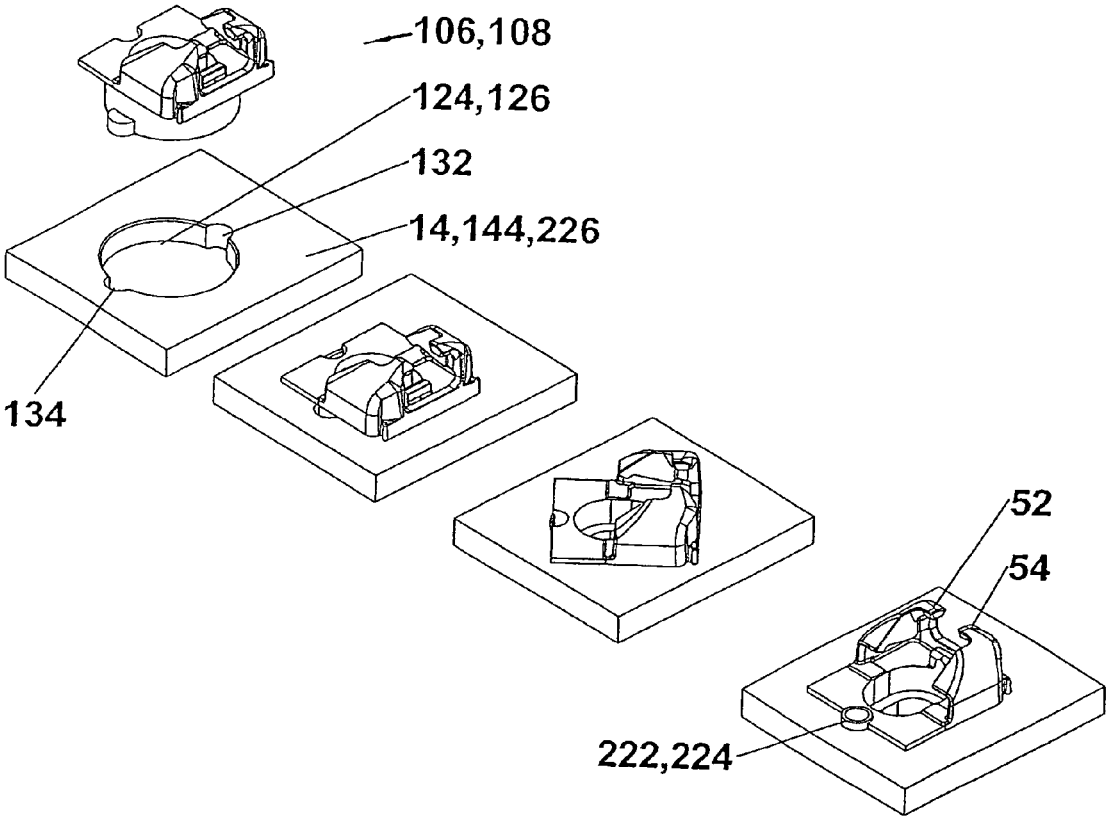
Figure 21:
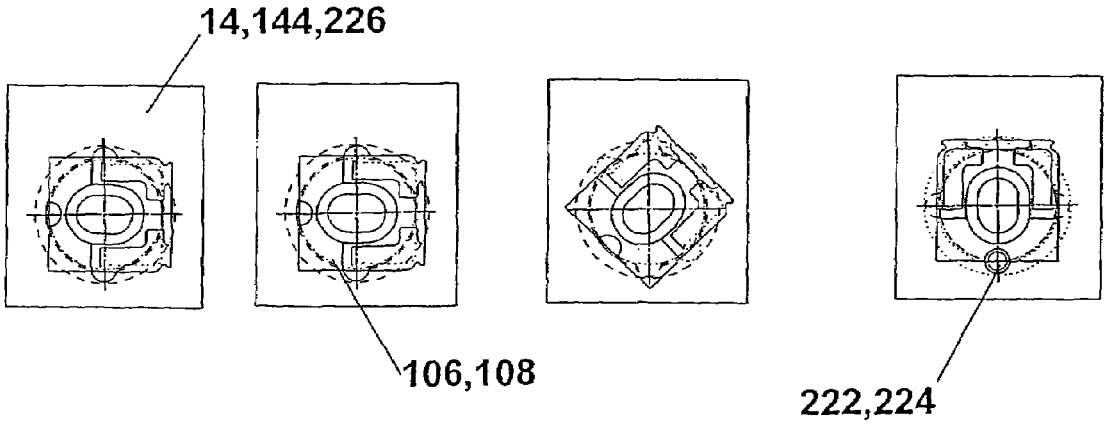

FIG. 16 shows an exploded view of the elements of FIGS. 14 and 15,

FIG. 17 shows a sectional view along the line E-E of FIG. 1,

FIG. 18 shows a plan view of the section of FIG. 16,

FIG. 19 shows an exploded view of the elements of FIGS. 17 and 18,

FIG. 20 shows perspective views of various positions of a holding element to be inserted into a ribbed plate, and FIG. 21 shows plan view corresponding to the illustrations in FIG. 20.

The Figures, which always use the same reference numbers for identical elements, illustrate fastenings for a rail extending in a rail switch. To fasten the rails, one employs resilient tensioning clamps,—also referred to as clips—and holding elements accepting the clips, as they have been described on principle in EP-B-0 619 852, in particular in its FIGS. 1-5. In this respect, reference is made to the relevant disclosure. However, the invention is not limited to the corresponding shape of the clips. Furthermore, the teaching of the invention is also realizable with clips of different geometry and with clips of a type that are accepted by holding elements, which for the purpose of securing clips have a channel, for example, instead of shoulders, as is known from the fastening system according to AT-C-350 608. In this respect, reference is particularly made to the relevant disclosure therein.

FIG. 1 shows, purely schematically, a layout of a simple rail switch towards the right. In this, the rails are supported on concrete ties and are secured, again purely as an example, by so-called Pandrol® clips, as described in EP-B-0 619 852.

FIGS. 2-7 illustrate the standard fastening of a rail on the track, i.e. a stock rail 10 immediately before the tip of the switch. The stock rail 10 rests in the usual manner upon an intermediate layer 12 (pad), which in turn is arranged on a load-distributing plate 14, which hereinafter will be referred as the ribbed plate. The rail 10 as well as its foot 16, i.e. the foot's side edges 18, 20, are secured by clips 22,24 resting upon them, which extend from holding elements 26, 28.

The ribbed plate 14 is supported by a resilient intermediate layer 30, which in turn rests on an essentially inflexible plate 32, made for example of hard plastic. In this exemplary embodiment, the plate 32 in turn extends directly from a concrete tie 34.

Below the rail foot 16, the resilient intermediate layer 30 can have, for example according to WO-A-200227099, recessed areas 36, which under normal loading of the rail 10 extend at a spacing from the intermediate plate 32. Under excessively high loads, the recessed regions will come to rest on the intermediate plate 32, so that the intermediate layer 30 will become stiffer.

The clips 22, 24 have in plan view an approximate M-shape and comprise the outer legs 38, 40, which merge through arch sections 42, 44 into the inner legs 46, 48, which in turn are connected by an arch section 50.

When fastening the clips 22, 24, the outer legs 38, 40 are driven into the holding elements 26, 28, in particular into so-called shoulders 52, 54, or rather into hollow spaces surrounded by the shoulders. Owing to the shape of the legs 38, 40, 46, 48 and the shape of the arch sections 42, 44, the arch section 50 subsequently rests with prestress upon the rail foot 16 or rather the respective longitudinal edge 18, 20 and thus holds down the stock rail 10. In this, the arch section 50 is surrounded by a sleeve 56 consisting of electrically insulating material.

The basic design of the clips 22, 24 was described on the basis of clip 22 alone, but this applies analogously to clip 24. In the following, the design of the holding elements 26, 28 will also be described by using holding element 26 as an example.

The holding element 26 and the shoulders 52, 54, which accept the outer legs 38, 40 and each of which has a laterally open U-shaped channel 58, 60 for accepting the legs 38, 40, originate in a plate-shaped base section 62, which in turn on its bottom has a shaped projection 64, which preferably exhibits a cup-shaped geometry with a circumferential wall 66 and a bottom wall 68. The bottom wall 68 is provided with a through-opening 70, to accept an insert 72, which can also be regarded as an adjusting cone. The insert has a through-opening 74, through which passes a shaft 76 of a through-bolt for securing the holding element 26 and thus the ribbed plate 14. For this purpose, the base section 62 rests with a first support surface 80 upon a section of the ribbed plate 14 forming a second support surface 82. The ribbed plate 14 has a through-opening 84 to be able to positively accept the shaped projection 64. To fasten the holding element 26, 28 and thus the ribbed plate 14, the respective holding element 26, 28, i.e. the shaped projection 64, is inserted into the corresponding opening 84 of the ribbed plate 14. Subsequently, the insert 72 is inserted into the through-opening 70 of the holding element 26. The through-bolt is then screwed into a nut 88, which is accommodated by a sleeve 86 arranged in the concrete tie 34. The sleeve 86 is accommodated by a widening 90, which extends from a socket 92, which is embedded in the concrete tie 34 and which surrounds the shaft 76 of the through-bolt 78 in its assembled state, as illustrated in the sectional view of FIG. 2.

The through-bolt 78, i.e. its head 94, is supported on a washer 96, which in turn rests on the interior surface of the bottom of the shaped projection 64. When the through-bolt 78 is tightened, the holding element 26, 28 is drawn onto the essentially rigid plate 32 and rests in frictional engagement with the latter. During this, the washer 96 rests upon the edge region of the interior surface of the bottom wall 68 surrounding the through-opening 70, which consequently is referred to as third support surface 98. Simultaneously, the ribbed plate 14 is pulled along, which resiliently prestresses the ribbed plate 14, since the distance between the first support surface 80 of the holding element 26 and its fourth support surface 100 resting on the plate 32 is smaller than the thickness of the ribbed plate 14 and the resilient intermediate layer 30 in the relaxed state, i.e. with loosened through-bolt 78. Tightening the through-bolt 78 consequently compresses the resilient intermediate layer 32, which allows the desired prestressing of the ribbed plate 14 to be achieved.

Under load, the stock rail 10 is able to deflect to the necessary degree. The resilient intermediate layer 30, together with the washer 96, thereby forms a spring system, which allows realization of a characteristic curve with a knee-point, which is shown in DE-C-42 43 990. Of course, an equivalent characteristic curve could also be achieved if the head 94 rested directly on the bottom wall 68.

Since the prestressing of the ribbed plate 14 is provided by the holding element 26, 28, a relative movement is possible between the ribbed plate 14 and the holding element 26, 28 and therefore the stock rail 10. As a result of this, the clip 22, 24 must if necessary execute spring excursions, in dependence on the subsidence of the stock rail 10, which can lead to loss of fatigue strength. To eliminate this possibility, the prestressing of the ribbed plate 14 can be realized, in accordance with the exemplary embodiment of FIGS. 5-7, by an insert 102, 104 passing through the holding element 26, 28. In this case, one employs a holding element 106, 108, which is positively connected to the ribbed plate in a bayonet-joint-like manner.

As illustrated particularly clearly in FIG. 7, the holding element 106, 108 has a shaped projection 110, which exhibits a circular cross-section with two peripherally protruding projections 112, which in turn have a semi-circular cross-sectional geometry. Irrespective of this, the shaped projection 110, corresponding to the shaped projection 64 of holding element 26, 28, has a circumferential wall 114 as well as a bottom wall 116 with an opening 118. Consequently, the circumferential wall 114 corresponds to a hollow cylinder. In contrast, the geometry of the circumferential wall 66 of the shaped projection 64 of the holding element 26, 28 has an oval cross-section, in order to secure, by interlocking insertion into the ribbed plate 14, a proper alignment of the clips 22, 24 relative to the rail foot 18 or its side edges 18, 20.

The circumferential wall 114 of the shaped projection 110 is surrounded, in a form-fitting manner, by inner surfaces 120, 122 of openings 124, 126 in the ribbed plate 14, the peripherally protruding projections 112 extending along the bottom 128 of the ribbed plate 14. Further, in accordance with the exemplary embodiment of FIGS. 2-4, the holding element 106, 108 rests with its base section 130, i.e. with the lower surface of the base section, forming the first support surface 80, upon the top of the ribbed plate 14, the clearance between the first support surface 80 and the peripherally protruding projection 112 corresponding to the thickness of the ribbed plate 14 in the region of the opening 124,126.

To allow insertion of the holding elements 106, 108 into the openings 124, 126, the openings 124, 126 have cut-outs 132, 134 matching the projections 112, the projections 112 passing through these in a position of the holding element 106 in which the latter is not aligned properly relative to the rail foot 16. When the holding element 106 has been inserted into the opening and the peripheral projections 112 extend along the bottom 128 of the ribbed plate 14, the holding element 106 is rotated to the proper alignment relative to the rail foot, the holding element 106 being connected to the ribbed plate 14 in a bayonet-joint-like manner. Now, the insert 102 is inserted into the opening 118 of the bottom wall 116. The insert 102 then exhibits a height such that during tightening of the through-bolt 78, the required prestressing of the ribbed plate 14 can be achieved by compressing an intermediate layer 136 arranged below the ribbed plate 14. The resilient intermediate layer 136 is then attached—otherwise than the exemplary embodiment of FIGS. 2-5—at the bottom 128 of the ribbed plate 114. This can be effected by vulcanizing.

Insertion of the holding element 106, 108 into the ribbed plate 14 and thus the interlocking and friction-locking joining of these is also illustrated by FIGS. 20 and 21, so that extensive explanations are not required. In FIGS. 20 and 21, the rail to be secured extends above the holding elements 106, 108, which is shown in various positions. Accordingly, the holding element 106, 108 initially is inserted into the ribbed plate 14, a part of which is shown, offset by 90° from its proper positioning and is subsequently rotated through 90°. In this position, shown in the illustrations on the right, the shoulders 52, 54 are oriented towards to the rail foot 16 or the side edge 18, 20 in such a manner that upon after driving the clip 22 or 24 into the space bordered by the shoulders 52, 54, the clip 22, 24 rests via its arch section 50, or the sleeve 56 surrounding the latter, on the edge section 18 or 20, respectively, and therefore holds down the rail 10 to the necessary degree.

Furthermore, the other reference numerals used in FIGS. 20, 21 correspond to those used in other figures for the corresponding illustrated elements.

Prior to driving the clip 22, 24 into the holding element 104, 106, the latter and therefore the ribbed plate are secured via the through-bolt 78, which is screwed into the nut 88 and is tightened. During this, the washer 96 rests upon the insert 102 and, when the through-bolt 78 has been tightened, the insert 102 rests upon the intermediate plate 32, which consists of a hard material. Therefore, the insert 102 is friction-locked between the intermediate plate 32 and the washer 96. Disks 138, 140 acting as disc springs can be arranged between the bolt head 94 and the washer 96, as illustrated in FIGS. 5-7. The disks 138, 140 act in a screw-locking manner. Alternative constructions, such as for example NORD-LOCK washers, are also possible.

As described in connection with FIGS. 2 to 4, the resilient intermediate layer 136 and the washer 96 form a compound spring system with a characteristic curve with a bend.

In the exemplary embodiment, the height of the insert 102, 104 is smaller than the thickness of the bottom wall 116 of the holding element 106, 108 and the thickness of the resilient intermediate layer 136 in the relaxed state.

Because the holding element 106, 108 is connected to the ribbed plate 14 by interlocking and friction-locking, these two are moved as a unit relative to the insert 102, 104, so that as a result no additional spring loads arise for the clips 22, 24 from a subsidence of the stock rail 10. Consequently, fatigue strength is ensured.

The design of a removable holding element, which can be used to indirectly or directly preload a load-distributing plate for a rail, in particular in the region of rail switches, and further can be used to preferably removably arrange the load-distributing plate, is not limited to application in the region of normal rails or in the region of a stock rail immediately before a switch blade, but can also find use in the region of a tongue blade 142, which for reasons of simplicity was omitted in FIGS. 8 and 9, but is included in the exploded view of FIG. 10.

In this region of the rail switch, corresponding to the section B-B of FIG. 1, the stock rail 10 is arranged on a ribbed plate 144, from which removably extends a slide plate 146, on which the tongue blade 142 is slidingly adjustable.

The slide plate 146 can be removably fastened to the ribbed plate 44 via bar spring elements 148, 150, which extend along the longitudinal side edges of the ribbed plate 144 and which can be loaded via thrust blocks 152, 154, which originate from the ribbed plate 144 and have a U-shaped cross-section. The thrust blocks 152, 154 extend between supports 156, 158, 160, 162 of the slide plate 146, upon which the bar spring elements 148, 150 rest when the slide plate 146 is fixed.

In its end region on the slide plate side, the ribbed plate 144 is secured by a through-bolt 164, which can be tightened by means of a nut 168, which is accommodated in a positive connection by a collar 166, extending within a concrete tie 170, from which extends the ribbed plate 144. Analogous to the explanations for the through-bolt 78, the shank 172 of the through-bolt 164 is surrounded by sleeve 174, which is cast into the concrete tie 170 and consists of an electrically insulating material.

As in the embodiments of FIGS. 2 to 7, the ribbed plate 144 is supported on a resilient intermediate layer 176, which can be arranged as separate element below the ribbed plate 144, or can be joined to the latter, which is preferably effected by vulcanizing. For prestressing the ribbed plate 144, i.e. to compress the resilient intermediate layer 176 to the desired extent in order to provide the required degree of resilient support for the support point formed by the ribbed plate 144 and the slide plate 146, a design is chosen that is equivalent to that of FIGS. 5 to 7. Therefore, the ribbed plate 144 is indirectly prestressed on the rail side by a holding element 108, which in principle corresponds to that in FIGS. 5 to 7, so that the clip resting on the rail foot 16, or rather on the side edge 20, or the left one in the illustration, is indicated by reference numeral 24.

Accordingly, the holding element 108 consists of a plate-like base section 178, which in a plan view is rectangular, from which extends a shaped projection 180 having a circular cross-section, which consists of a circumferential wall 182 equivalent to a section of a hollow cylinder as well as a bottom wall 184, which has a through-opening 186, into which an insert 188 can be inserted with positive connection. The insert 188 accepts a through-bolt 190, which can be screwed into a nut 192, which in turn is accepted in a positive connection by a collar 194 in the concrete tie 170.

The insert 188 has a height, which, when the through-bolt 190 is tightened and there is thus a friction-locked contact of the insert 188, on the one hand, on the plate 196, which is arranged on the concrete tie 170 and consists of inflexible material such as hard plastic, and on the other hand at the washer 198, through which extends the through-bolt 190, ensures that the resilient intermediate layer 176 is compressed by the holding element 108 and the ribbed plate 144 connected to the latter to a degree that is sufficient to achieve the desired prestressing. Discs 202, 204 acting as disc springs can in that case be arranged between the head 200 of the bolt 290 and the washer 198, in accordance with the illustration of FIGS. 5 to 7.

The washer 198, which rests frictionally on the top of the insert 188, is also supported on the inner surface of the bottom wall 184 of the holding element 108, which in turn is connected by interlocking and friction-locking to the ribbed plate 144, as was described in connection with FIGS. 5 to 7. In other words, projections 206 protrude peripherally from the outer surface of the circumferential wall 182, which, given a proper orientation of the holding element 108 relative to the rail foot 106, will extend along the bottom surface of the ribbed plate 144.

To allow insertion of the holding element 108, the ribbed plate 144, which positively accepts the holding element 108, i.e. its shaped projection 180, has a corresponding through-opening 208 with an inner geometry that corresponds to the outer geometry of the shaped projection 180, whereby the cut-outs 210, 212 corresponding to the projections 206 extend in such a manner that the holding element 108 is to be inserted into the ribbed plate 144 in a position in which the clip 24 would not be supported properly, or would not at all be supported, on the rail foot 16, so that consequently the holding element 108 must be rotated to reach its operating position. As a result of this, the projections 206 extend below the ribbed plate 144 without a possibility of detaching the holding element 108.

In other words, a design of this type realizes a bayonet-joint-like connection between the holding element 108 and the ribbed plate 144.

For completeness sake, it must be pointed out, with regard to the embodiment of FIGS. 8 to 10, that a further intermediate layer (pad) 214 can be located between the foot 16 of the stock rail 10 and the ribbed plate 144, and likewise between the slide plate 146 and the ribbed plate 144. The corresponding pad is indicated by reference numeral 216.

The clip 24, in the exemplary embodiment, rests on the left side edge 20 of the stock rail 10. The opposing side edge 18 is hold downed by the slide plate 146. In this respect we refer to the customary designs.

The prestressing of the ribbed plate 144, i.e. the compression of the resilient intermediate layer 176, is achieved in the end region of the ribbed plate 144, on the slide plate side, via the through-bolt 164, which, via a washer 218, rests on an insert 220, having a height that is smaller than the thickness of the ribbed plate 144 and the thickness of the resilient intermediate layer 176 in the relaxed state, i.e. when the through-bolt 164 is loosened. Therefore, if the insert 220 is tightened between the washer 218 and the plate 196, the resilient intermediate layer 176 is compressed accordingly. Naturally, the height of the insert 220 is greater than the thickness of the ribbed plate 144.

To ensure that the holding element 108 and likewise the holding element 106 of FIGS. 5 to 7 is not only properly oriented towards the rail foot 16 to hold down the latter, but also will remain in that position, a lock pin 222, 224 is provided, which can be inserted into a recess formed by sections of the ribbed plate 14, 144 and the corresponding holding element 106, 108. The lock pin 222, 224 can only be inserted into the recess formed in this manner if the component sections are properly aligned relative to each other, i.e. form the opening for inserting the lock pin 222, 224, as schematically shown in the drawings.

FIGS. 11 to 13 correspond to the section C-C in FIG. 1 extending in the region of the tongue heel. In this region, the tongue blade 142 is supported on and fixed to an intermediate plate 228, which is arranged on a ribbed plate 226 and forms an elevated area. For this, clips and holding elements are used which were described with reference to FIGS. 5 to 10, so that on principle the same reference numerals are used for identical elements. Consequently, the clip 24 securing the stock rail 10 extends from the holding element 108, which as mentioned earlier is connected to the ribbed plate 226 in a bayonet-joint-like manner.

In other words, the base section 178 extends along the top of the ribbed plate 226 and the projections 206, given a properly inserted holding element 108, extend along the bottom surface of the ribbed plate 226. This is how the desired positive connection is ensured in bayonet-joint-like manner. The prestressing of the ribbed plate 226 is accomplished via the friction-locked fit of the insert 188 between the plate 232, which is arranged on a concrete tie 230 and consists of a hard material, and the washer 198, through which passes the through-bolt 190, which can be tightened by means of the nut 192 secured in the concrete tie 230.

When the clip 24 is properly aligned relative to the side edge 20 of the rail foot 16, the holding element 108 can also be locked by means of the lock pin 222.

The side edge 233 of the foot of the tongue blade, which faces away from the stock rail also serves as support for a clip 234 of the previously-described design, which extends from a holding element 236, which has a plate-like base section 238 that rests upon the top 240 of the intermediate plate 228. The holding element 236 is then connected by interlocking and friction-locking to the intermediate plate 228 and the ribbed plate 226, which supports the intermediate plate 228 and in the exemplary embodiment is made in two pieces. This is realized in a manner described previously. For this purpose, a shaped projection 242 extending from the base section 238 has protruding projections 244, which in the usual manner can be inserted positively into the intermediate plate 228 and the ribbed plate 226 and subsequently rotated relative thereto. In this respect, reference is made to the description relating to FIGS. 5-10.

The through-opening 246 of the holding element 236 accommodates an insert 248, the height of which provides the prestressing of the ribbed plate 226, i.e. the compression of the resilient intermediate layer 250 extending from the bottom of the ribbed plate 226, which can be vulcanized to the bottom of the ribbed plate 226 or can be embodied as separate layer. The intermediate layer 250 can thereby have a fundamental design, as shown for example in EP-A-0 953 681, i.e. can have recessed sections that only come to rest on the plate 232 if, under excessively high loads acting upon the stock rail 10 or the tongue blade 142, it is desired that the intermediate layer 250 become stiffer.

To hold down or load the stock rail 10 and the tongue blade 142 with appropriate above-described clips at their mutually opposed side edges 18, 25, a design was chosen that has independent inventive merit. Between the stock rail 10 and the tongue blade 142 extends a holding element 254, which has a plate-like base section 256, which is rectangular in plan view, with a shaped projection 258 of rectangular cross-section extending from the bottom of the base section. Analogous to the exemplary embodiment described above, the cross-section of the shaped projection 258 is smaller than that of the base section 256. The shaped projection 258 has a through-opening, through which a through-bolt 288 can pass.

Viewed longitudinally of the rails 10, 142, two pairs of shoulders, 262, 264 and 266, 268 extend at some distance from each other, which in each, like the above-described holding elements, form channel-like receptacles with U-shaped cross-sections for the outer legs of clips 270, 272, which have a design and function corresponding to those of e.g. clips 22, 24. Extending between the shoulders 262, 264 on one side and the shoulders 266, 268 on the other side, there is an intermediate plate 274, which can be viewed as a bridge element and which is adjustable relative to the holding element 254, and rests by border sections 280, 282, bounded by steps 276, 278, upon the rail foot 16, 236 of the stock rail 10 and the tongue blade 142, respectively, or rather their side edges 18, 252, as is particularly well illustrated in the sectional view of FIG. 11.

The centre legs of the clips 270, 272 then rest upon the top 286 of the intermediate plate 274, whereby the intermediate plate 276 is pressed onto the rail feet 16, 233. Therefore, narrowly spaced rails, i.e. the stock rail 10 and the tongue blade 142 in the exemplary embodiment, can be loaded in a space-saving manner via clips that are employed in the other parts of the rail switch.

To ensure identical geometric conditions with respect to holding down, such as when the clips are directly supported on a rail foot, the top surface of the intermediate plate 274 preferably has a roof-like geometry with slopes that correspond to those of the support surfaces of the rail feet 16, 236 in those regions, which usually serve as support for the clips.

Analogous to the holding elements 108, 236, the holding element 254 is fastened via the through-bolt 288. Since the holding element 254 does not grip or have a positive connection to the ribbed plate 256—as was described on the basis of FIGS. 5 to 10—, but is only positively inserted into a matching through-opening 290, a relative movement between it and the holding element 256, and thus additional loading on the clips 270, 272, can occur in dependence on the subsidence of the ribbed plate 226. However, since the holding element 254 is secured by the through-bolt 288 in the centre region of the intermediate plate 274, which is considered a bridge element, the spring excursions which occur can be kept low enough to not affect the fatigue strength of the clips 270, 272. Also contributing to this is that the ribbed plate 262 is split in the region of the through-opening 290, so that a relative movement occurs between the section 292 accepting the stock rail 10 and the section 294 supporting the tongue blade 142. Correspondingly, the resilient intermediate layer 250 is also divided into sections 296, 298. The contact lines between the sections 292, 294 and 296, 298, respectively, then pass through the through-opening 290.

A so-called double-securement, as was described in connection with the holding element 254 and the directly adjacently extending stock rail 10 and tongue blade 142, can also be found in the section D-D of FIG. 1, the details of which are shown in FIGS. 14 to 16. Again, for elements that have already been described, in principle the same reference numerals have been employed. The rail sections 300, 302 merging into the tongue blade and the wing rail are held down on the outside by clips, which extend from holding elements and correspond to those of FIGS. 5 to 7. Consequently, holding elements 106, 108 extend positively from a ribbed plate 304, which is split in this exemplary embodiment. The clips 22, 24 can be driven into the holding elements 106, 108, after the holding elements 106, 108 have been properly aligned relative to the respective rail-foot side edges. In this position, the holding elements 106, 108 are secured against rotation relative to the ribbed plate 304 by lock pins 222, 224. The prestressing of the ribbed plate 304, or rather its sections 306, 308, upon each of which rests one of the rail sections 300, 302, is accomplished via the inserts 102, 104, which pass through the shaped projections 114 of the holding elements 106, 108 and have a positive connection to a concrete tie 310 via the through-bolts 78, i.e. are fixed between the washer 96, through which the through-bolt passes, and the plate 32. Accordingly, arranged between the plate 32 and the ribbed plate 304 there is an resilient intermediate layer 312, which, analogously to the ribbed plate 304, is embodied in two pieces (sections 314, 316).

On the other hand, the mutually opposed side edges 318, 320 of the rail sections 300, 302 are held down by means of clips and an intermediate plate or bridge element, as has been described in connection with FIGS. 11-13. In other words, between the rails 300, 302 extends a holding element 322, from which extend two pairs of shoulders 321, 323, 327 with unlabelled channel-like receptacles for outer legs of clips, which correspond to the clips of the previously described type, i.e. the clips 270, 272, so that the reference numerals relating thereto are used. The holding element 322, corresponds in construction to the holding element 254, also has a plate-like or quadratic base section 256 with a shaped projection 258, which has a through-opening, through which passes a through-bolt 324 corresponding to the through-bolt 260 of FIG. 13, to fasten the holding element 322.

Across the holding element 322 extends an intermediate plate 326, which can also be viewed as a bridge element and which performs the function of the intermediate plate 274 of FIGS. 11-13.

Therefore, the intermediate plate 326 is a separate component part, which is placed upon the holding element 322, i.e. the top of the base section 256, whereby for the purpose of achieving proper alignment relative to the holding element 322, the intermediate plate 326 has, on its side facing the holding element, a recess 328 having a width corresponding to that of the base section 256. In the case of proper positioning, the intermediate plate 326 lies, at its side edges, which are bounded by steps 334, 336, on the longitudinal side edges 338, 340 of the rail sections 300, 302, so that subsequently the clips 270, 272 are driven into the holding element 322, i.e. into the shoulders 321, 323, 325, 327.

The fact that the holding element 322 extends in the split region of the sections 306, 308 of the ribbed plate 304 allows a relative movement between the rail sections 300, 302 to take place, the spring loading of the clips 270, 272 being simultaneously reduced.

A sectional view E-E of FIGS. 17 to 19 reflects the situation of the rail switch in the region of the guide rails. A rail section 342, along which extend supports 344 for accepting guide rail inserts 346, is fastened by holding elements and clips, which can correspond to the construction of FIGS. 2 to 4, in particular FIGS. 5 to 7, i.e. a position outside of a rail switch. In this respect, the same reference numerals are used for identical elements, the construction of FIGS. 17 and 19, in which the prestressing of the ribbed plate 14 is accomplished via the inserts 102, 104, being selected so that consequently the holding elements 106, 108 have a positive connection to the ribbed plate 14, so that no relative movement can take place between them.

The supports 344 are connected by through-bolts to the concrete tie 348 accommodating the rail section 342. In this regard, reference is made to sufficiently well known designs.

LIST OF REFERENCE NUMBERS

10 Stock rail
12 Intermediate layer (pad)
14 Ribbed plate
16 Foot
18 Longitudinal edge
20 Longitudinal edge
22 Clip
24 Clip
26 Holding element
28 Holding element
30 Resilient intermediate layer
32 Intermediate plate
34 Concrete tie
36 Section of the resilient intermediate
38 Outer leg
40 Outer leg
42 Arch section
44 Arch section
46 Inner leg
48 Inner leg
50 Arch section
52 Shoulder
54 Shoulder
56 Sleeve
58 Channel
60 Channel
62 Base section
64 Shaped projection
66 Peripheral wall
68 Bottom wall
70 Through-opening
72 Insert
74 Opening
76 Shank
78 Through-bolt
80 First support surface
82 Second support surface
84 Opening
86 Sleeve
88 Nut
90 Widening
92 Socket
94 Head
96 Washer
98 Third support surface
100 Fourth support surface
102 Insert
104 Insert
106 Holding element
108 Holding element
110 Shaped projection
112 Projection
114 Peripheral wall
116 Bottom wall
118 Opening
120 Inner surface
122 Inner surface
124 Opening
126 Opening
128 Bottom
130 Base section
132 Cut-out
134 Cut-out
136 Intermediate layer
138 Disc
140 Disc
142 Tongue blade
144 Ribbed plate
146 Slide plate
148 Bar spring element
150 Bar spring element
152 Thrust block
154 Thrust block
156 Support
158 Support
160 Support
162 Support
164 Through-bolt
166 Sleeve
168 Nut
170 Concrete tie
172 Shank
174 Socket
176 Resilient intermediate layer
178 Base section
180 Shaped projection
182 Peripheral wall
184 Bottom wall
186 Through-opening
188 Insert
190 Through-bolt
192 Nut
194 Sleeve
196 Plate
198 Washer
200 Head
202 Disc
204 Disc
206 Projection
208 Through-opening
210 Recess
212 Recess
214 Intermediate Layer
216 Pad
218 Washer
220 Insert
222 Lock pin
224 Lock pin
226 Ribbed plate
228 Intermediate Plate
230 Concrete tie
232 Plate
234 Clip
236 Holding element
238 Base section
240 Top
242 Shaped projection
244 Projection

246 Through-opening
248 Insert
250 Intermediate layer
252 Longitudinal side edge
254 Holding element
256 Base section
258 Shaped projection
262 Shoulder
264 Shoulder
266 Shoulder
268 Shoulder
270 Clip
272 Clip
274 Intermediate plate
276 Step
278 Step
280 Border section
282 Border section
286 Top
288 Through-bolt
290 Through-opening
292 Section
294 Section
296 Section
298 Section
300 Rail section
302 Rail section
304 Ribbed plate
306 Section
308 Section
310 Concrete tie
312 Resilient intermediate layer
314 Section
316 Section
318 Lengthwise side edge
320 Lengthwise side edge
321 Shoulder
322 Holding element
323 Shoulder
324 Through-bolt
325 Shoulder
326 Intermediate Plate
327 Shoulder
328 Recess
330 Lengthwise side edge
332 Lengthwise side edge
334 Step
336 Step
338 Lengthwise side edge
340 Lengthwise side edge
342 Rail section
344 Support
346 Guide rail insert
348 Concrete tie
350 Through-bolt
352 Through-bolt

The invention claimed is:

1. Arrangement for fastening a rail (10, 142, 222, 224, 252, 300, 302) having a rail foot (16, 236, 258) resting on a support (34, 170, 230, 310, 348), comprising a load-distributing plate (14, 144, 226, 228, 304), arranged between the rail foot and the support, a resilient first intermediate layer (30, 136, 176, 250, 312) supporting the load-distributing plate relative to the support, and, if required, a second intermediate layer (32, 196, 232), which extends between the first intermediate layer and the support and comprises an essentially non-resilient material, a holding element (26, 28, 106, 108, 236, 254, 322) connected to the support, from which holding element extends at least one elastic clip (22, 24, 234, 270, 272) having several legs (38, 40, 42, 44, 46, 48, 50) and which supports itself on the rail foot, wherein the holding element (26, 28 106, 108, 2336, 254, 322) is an insert, which is removably insertable into the load-distributing plate (14, 144, 226, 228, 304) and which allows movement relative to the load-distributing plate in the direction of the support (34, 170, 230, 310, 348), whereby the load-distributing plate is directly preloadable via the holding element relative to the support, or in that the holding element is formed together with the load-distributing plate as a unit, the holding element forming a unit with the load-distributing plate having a through-opening (70, 118, 186, 246), in which is arranged a second insert (62, 102, 304, 188, 220, 248), which insert is movable relative to the holding element and allows an adjustment relative to the holding element, and through which passes a screw element (78, 164, 190, 288, 324), connecting the holding element and the support (34, 170, 230, 310, 348) and which can be screwed into the support, whereby the load-distributing plate can be indirectly preloaded relative to the support by the holding element.

2. Arrangement of claim 1, characterized in that the holding element (26, 28, 106, 108, 236, 254, 322) has a base section (62, 130, 238, 256) with a shaped projection (64, 110, 180, 242, 258) extending along the bottom, and that from the region of the base section facing away from the shaped projection there extends at least one receptacle (52, 54, 262, 264, 266, 268, 321, 323, 325, 327) in which extends one leg (38, 40) of the clip (22, 24, 234, 270, 272).

3. Arrangement of claim 2 characterized in that the shaped projection (64, 110, 180, 242, 258) has a cross-section with generally circular geometry and having a planar extent that is smaller that the planar extent of the base section (62, 130, 238, 256).

4. Arrangement of claim 2, characterized in that the shaped projection (64, 110, 180, 242, 258) has a cup-like geometry, with a bottom wall (68, 116, 184) having an opening (70, 118, 186, 246).

5. Arrangement of claim 2, characterized in that the shaped projection (64, 110, 180, 242, 258) engages positively in the load-distributing plate (14, 144, 226, 228, 304).

6. Arrangement of claim 2, characterized in that the load-distributing plate (14, 144, 226, 228, 304) is provided with a through-opening (124, 126) with a geometry that matches the outer geometry of the shaped projection (64, 110, 180, 242, 258).

7. Arrangement of claim 2, characterized in that the holding element (26, 28, 106, 108, 236, 254, 322) rests through a first support surface (80) upon a section, forming a second support surface (82), of the load-distributing plate (14, 144, 226, 228, 304).

8. Arrangement of claim 2, characterized in that at least two projections (112, 206, 244) protrude peripherally from the shaped projection (64, 110, 180, 242, 258), which has a hollow-cylinder geometry, and in that the clearance of each of said projections from the first support surface (80) extending from the holding element (26, 28, 106, 108, 236, 254, 322) is substantially equal to the clearance between the second support surface (82, extending from the load-distributing plate (14, 144, 226, 228, 304), and the lower surface (128) of the load-distributing plate, from which extends the resilient first intermediate layer (30, 136, 176, 250, 312).

9. Arrangement of claim 1, characterized in that the holding element and the load-distributing plate are formed as a single unit, for example by casting.

10. Arrangement according to claim 1, characterized in that the screw element connecting the holding element (26, 28, 106, 108, 236, 254, 322) to the support (34, 170, 230, 310, 348) is a through-bolt.

11. Arrangement of claim 1, characterized in that when the holding element (26, 28, 106, 108, 236, 254, 322) is fastened, the screw element (78, 164,190, 288, 324) through which the screw element passes, supports itself frictionally upon a third support surface (98), which faces away from the support.

12. Arrangement of claim 11, characterized in that when the screw element (78, 164, 190, 288, 324) is frictionally supported on the second insert (62, 102, 104, 188, 220, 248), the resilient first intermediate layer (30, 136, 176, 250, 312) is in a compressed state.

13. Arrangement of claim 1, characterized in that a fourth support surface (100) is provided and when the screw element (78, 164, 190, 288, 324) is supported frictionally upon the holding element (26, 28), the latter rests via said fourth support surface (100) on the support(34), whereby the clearance between the first and the fourth support surfaces (80, 100) of the holding element is smaller than the thickness of the resilient first intermediate layer (30), when the screw element is loosened, and the clearance between the second support surface (82) and the bottom (128) of the load-distributing plate (14).

14. Arrangement of claim 1, characterized in that the holding element (26, 28, 106, 108, 236, 254, 322) is connected by interlocking to the load-distributing plate (14, 144, 226, 228, 304) in a bayonet-joint-like manner.

15. Arrangement of claim 1, characterized in that from the base section (62, 130, 238, 256) of the holding element (26, 28, 106, 108, 236, 254, 322) two shoulders (52, 54, 262, 264, 266, 268, 321, 323, 325, 327) extend, each of which accepts one leg section (38, 40) of the clip (22, 24, 234, 270, 272), and in that a screw element extends between the shoulders, whereby when the holding element is connected to the support (34, 170, 230, 310, 348), the head (94, 200) of the screw element extends below the clip (22, 24, 234, 270, 272).

16. Arrangement of claim 1, and further including a tongue blade (142), said load-distributing plate is an intermediate plate (228), which supports said tongue blade in its heel area, and which is provided with a through-opening having a cross-section that corresponds to the outside geometry of the holding element (236).

17. Arrangement of claim 1, characterized in that the holding element (236, 322) is arranged between two rails (10, 142; 300, 302) running immediately next to each other, in that receptacles (262, 264, 266, 268, 321, 323, 325, 327) for two clips (270; 272) extend from the holding element, in that the clips are supported on a plate element (274, 326) that is adjustable relative to the holding element, and in that the plate element itself is supported on the rail feet (16, 236; 318, 320) of the rails.

18. Arrangement of claim 1, characterized in that two pairs of shoulders (262, 264, 266, 268, 321, 323, 325, 327) extend from the holding element (236, 322), in that from each pair of shoulders extends a clip (270, 272), and in that between the two pairs of shoulders extends the plate element (274, 326), which rests upon the rail feet and is adjustable relative to the holding element.

19. Arrangement of claim 1, characterized in that the plate element (274, 326), which extends between the rails (10, 142, 300, 302) running immediately next to each other and which rests upon the feet (16, 236, 318, 320) of said rails, provides support surfaces for the clips (270,272) with a slope that corresponds to the slope of the rail feet in regions, in which clips usually support themselves.

20. Arrangement of claim 1, characterized in that the holding element (236, 322) arranged between the rails (10, 142, 300, 302) running immediately next to each other, has a base section (256) of quadratic geometry, and in that the shaped projection (258) extending from the bottom surface of the base section has a rectangular cross-section with rounded corners, in that the shaped projection passes through a through-opening (290) of the load-distributing plate (226, 304), and in that the load-distributing plate consists of two sections (292, 294, 306, 308), which join along a separating line that extends perpendicular to the longitudinal axis of the load-distributing plate, the separating line intersecting the through-opening at its center.

21. Arrangement of claim 1, characterized in that the resilient first intermediate layer (250, 312) is formed in two pieces and has a separating line with a path that coincides with the path of the separating line between the sections (292, 294, 306, 308) of the load-distributing plate (226, 304).

22. Arrangement of claim 1, characterized in that the support is a concrete tie.

23. Arrangement of claim 1, characterized in that the support is a ribbed plate.

24. Arrangement of claim 1, characterized in that the second intermediate layer is formed of a hard plastic.

25. Arrangement of claim 1, characterized in that when the holding element (26, 28, 106, 108, 236, 254, 322) is fastened, a disc-shaped element (96, 198) through which the screw element passes, supports itself frictionally upon a third support surface (98), which faces away from the support.

* * * * *